US005839158A

United States Patent [19]

Schupp et al.

[11] Patent Number: 5,839,158

[45] Date of Patent: Nov. 24, 1998

[54] SWEEPING BROOMS

[75] Inventors: Andreas Schupp; Timmy Hok Yin Sin, both of New Territories, Hong Kong

[73] Assignee: Techtronic Industries Co., Ltd., Hong Kong

[21] Appl. No.: 795,416

[22] Filed: Feb. 4, 1997

[30] Foreign Application Priority Data

Feb. 7, 1996 [GB] United Kingdom ..... 9602422
May 16, 1996 [GB] United Kingdom ..... 9610290

[51] Int. Cl.[6] ..... A47L 5/28

[52] U.S. Cl. ..... 15/350; 15/144.4; 15/344; 15/398; 15/410

[58] Field of Search ..... 15/350, 344, 398, 15/410, 144.4

[56] References Cited

U.S. PATENT DOCUMENTS

| | | | |
|---|---|---|---|
| 4,319,380 | 3/1982 | Simm et al. | 15/144.4 X |
| 4,662,026 | 5/1987 | Sumerau et al. | 15/144.4 X |
| 4,956,892 | 9/1990 | Fawkes | 15/398 X |
| 4,989,295 | 2/1991 | Guhne et al. | 15/144.4 X |
| 5,432,976 | 7/1995 | Alazet | 15/398 X |
| 5,440,782 | 8/1995 | Yamashita | 15/398 |
| 5,511,269 | 4/1996 | Watson | 15/144.4 X |
| 5,617,610 | 4/1997 | Dearaujo | 15/328 |
| 5,638,572 | 6/1997 | Ferrari | 15/350 X |

*Primary Examiner*—Chris K. Moore
*Attorney, Agent, or Firm*—Miller, Sisson, Chapman & Nash, P.C.

[57] ABSTRACT

A combined vacuum cleaner and broom device includes an elongate hollow handle connected at its lower end to separable housing parts. The housing part contains an electric motor and fan and the housing part contains a dust collecting compartment. Lines of bristles extend across a lower end of the housing part and form between them a dust passage. The dust passage is partly closed off by elongate porous resilient pads. Rechargeable batteries are stored with the handle and an electric switch with a slidable operating disc turns the motor ON and OFF. The lines of bristles are relatively off-set with respect to the height of the device to provide a normal sweeping orientation during use, that is with the handle at say 25° to the vertical. The device is normally used simultaneously as a broom and the vacuum cleaner.

3 Claims, 3 Drawing Sheets

SWEEPING BROOMS

The invention relates more particularly to domestic sweeping brooms primarily for use in the house. In normal cleaning and sweeping a long handled bristled broom is used to clear a floor surface of dust and debris. The user first sweeps the dust and debris into convenient piles and then sweeps up the piles onto a separate dust pan so the debris can be carried away to a dust bin, for example.

It is already known to provide domestic hand holdable electrically powered dust collectors that, broadly stated, replace the "dust pan and (hand) brush" commonly used about a kitchen or workshop, for example. A normal hand brush is not normally suitable for cleaning large areas, carpeted floors or comfortable to use (much bending and stretching being required). Further, the currently known dust collectors, which are usually cordless appliances, are not comfortably or suitably shaped to carry out non-contact sweeping, really "scanning", over significant floor areas, especially where at least somewhat obstructed regions are present, for example under a low overhang of a wall cupboard.

It is an object of the invention to overcome or at least reduce these problems.

According to the invention there is provided a combined vacuum cleaner and broom device having a hollow elongate handle extending to a housing at one end which incorporates an electric motor, a fan and a dust collecting compartment, two lines of bristles extending across a remote end of the housing which provide between the two lines an aperture for passage of dust and debris into the dust collecting compartment, and in which a battery compartment is formed inside the handle extending along its length for holding batteries to supply the motor.

The housing is preferably generally flat and wide and the bristles are mounted to extend across the width of the remote end of the housing.

The handle is preferably releasably attached to the housing.

The housing is preferably formed in two parts which are releasably clipped together to allow the parts to be separated and the dust compartment emptied.

The separated part can be exchanged for other parts having different forms of bristles or surface rubbing elements.

An electric switch for electrically connecting the motor to the batteries may have a switch operating disc that extends externally around the handle and is operable by slidable longitudinally movement with respect thereto.

The lines of bristles are preferably provided at different depths in relation to the height of the device, the arrangement being such that both lines of bristles fit snugly on a floor surface when the broom handle is at a chosen respective angle between 20° and 45° to the vertical.

A pad of resilient porous material may be provided adjacent one or each line of bristles (but preferably only the longer bristles) which partly close off the dust passage between the bristles to improve the effective sucking effect of the vacuum cleaner in use.

A combined vacuum cleaner and broom device according to the invention will now be described by way of example with reference to the accompanying drawings in which.

Figure 1:
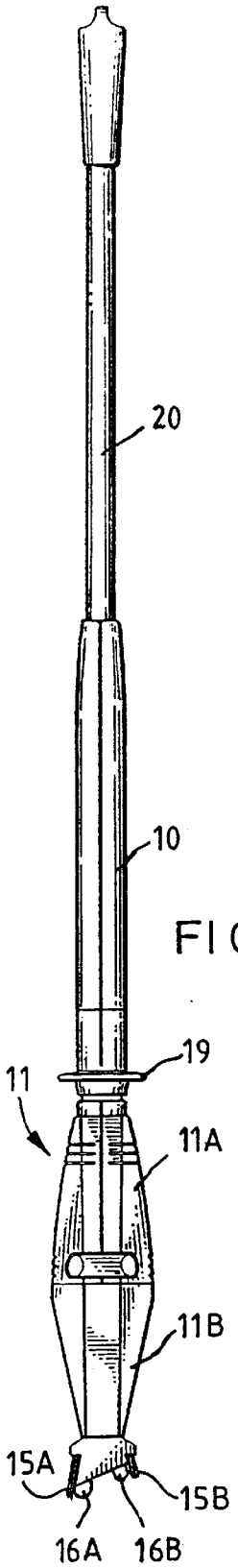
FIG. 1 is a side view of the device.

Referring to the drawings, the device has an elongate hollow handle 10 attached at its lower end to a housing 11 formed as two parts 11A and 11B. The housing 11 is generally flat and wide and incorporates an electric motor 12, a fan 13 and a dust collecting compartment 14 (see FIG. 6). Along the bottom or remote end of the compartment 11B are two lines of bristles 15A and 15B (see FIG. 1) extending across the width of the compartment 11B. There is a rectangular aperture or dust passage between the two lines of bristles 15A and 15B to allow dust and debris to enter the compartment 14. The dust passage is partly closed off by elongate pads 16A and 16B which extend along adjacent respective of the lines of bristles. The pads are formed of resilient porous material that helps to effectively seal off the dust passage to increase the sucking effect of the fan 13 in use.

Figure 4:
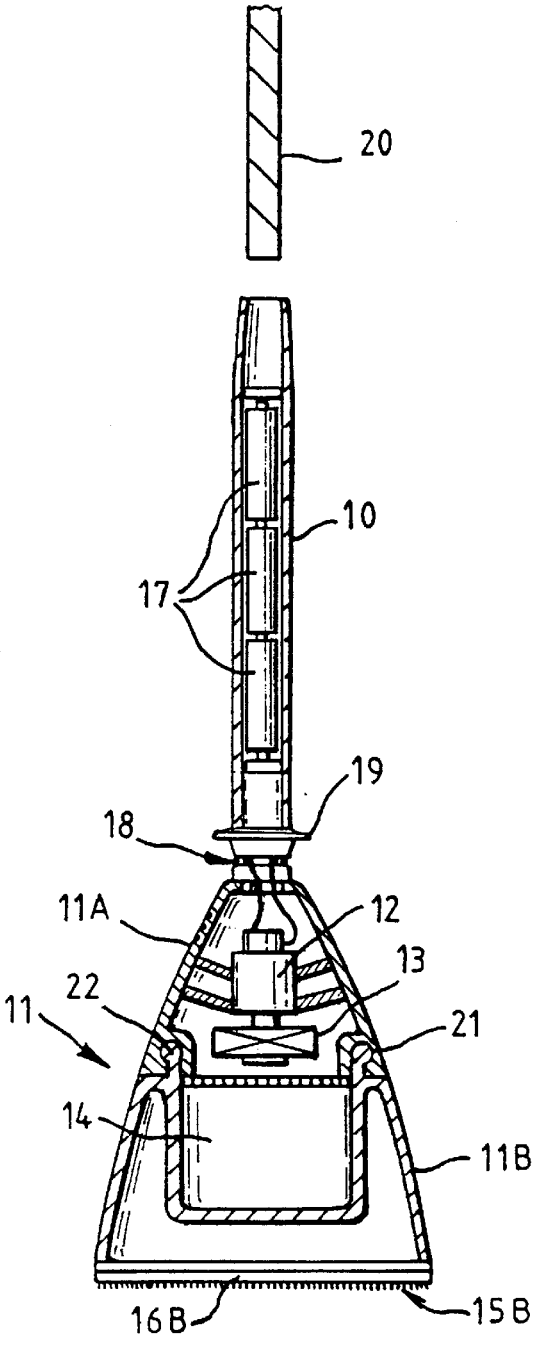
FIG. 4 is a part sectional front view of the device.

The electric motor 12 is supplied with power by batteries 17 mounted in a battery compartment formed within the handle 10. An electric switch 18 which is operated by pressing a disc 19 downwards to slide the disc down the outside of the handle 10. The disc 19, which extends around the handle, can be conveniently pressed or pushed by a hand or a foot irrespective of the relative orientation between the housing 11 and the user. The handle 10 has a removable extension 20 of fixed length, shown detached in FIG. 4, that is normally frictionally held firmly with one end inside the top end of the handle 10 in use.

The batteries are normally re-chargeable and a socket is provided (not shown) in the side of the handle 10 so that the batteries can be electrically connected to receive charging current from a mains supply. In some embodiments, the handle 10 is normally removable from the housing 11 for long term storage or transportation, but the device can be arranged to hang against a wall on a bracket with the handle 10 attached.

It is arranged in practice, but not shown, to have a protruding mains supply outlet in the bracket which provides charging current to the batteries. When the device is mounted to the bracket the outlet fits into and through an aperture in the handle 10 to connect to supply the batteries. The bracket is designed with a slot to receive the disc 19 and such that the device cannot be fitted to the bracket unless the switch 19 is in its OFF position. This prevents the device being stored or put away if it is not turned OFF and also ensures that battery charging can only take place with the switch 19 OFF.

Figure 5:
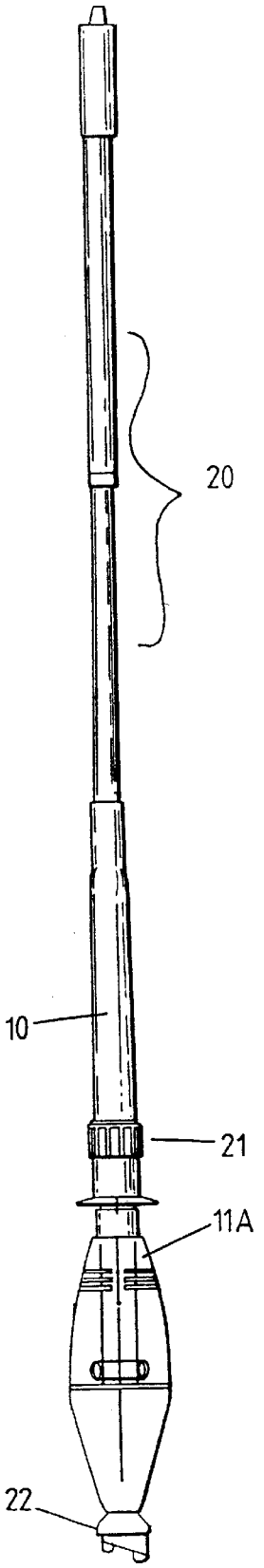
FIG. 5 is a side view of a modified device with an extendable handle fully extended.
Figure 6:
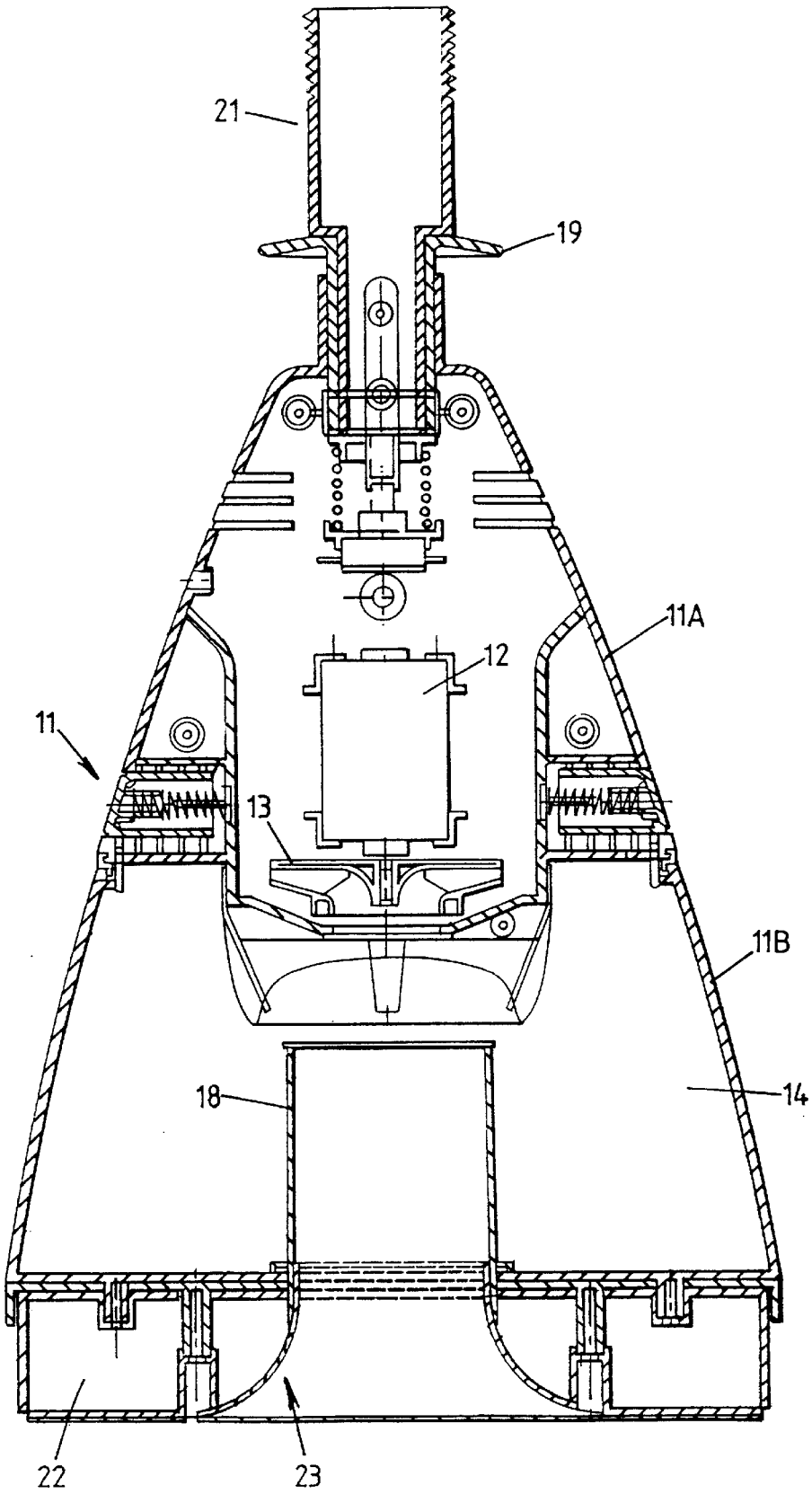
FIG. 6 is a cross-sectional front view of part of the device of FIG. 5.

It will be noted that the parts 11A and 11B are clipped together effectively at four points. If opposing clips (shown in FIG. 1) are released, the compartment 11B can swing and pivot initially about clips 22 before becoming released completely from the part 11A. In FIGS. 5 and 6, only two opposing clips are used.

Importantly, it can be seen in the Figures (especially FIG. 1) that the line of bristles 15A is significantly lower than the line of bristles 15B. This means that for a natural position for sweeping where the handle is selectably at somewhere between 20° to 45° to the vertical, both lines of bristles can rest snugly and be pressed together against a horizontal surface. In other words, with a natural or comfortable sweeping actions, with the handle at say 30° to the vertical, the relative height disposition between the lines of bristles 15A and 15B ensures that a floor surface is swept efficiently.

In practice, the described device is normally used for sweeping. (It could be used for wiping or rubbing if a dampened sponge arrangement is used instead of bristles)

while simultaneously vacuum cleaning. Vacuum cleaning could of course be carried out intermittently and used only to remove gathered piles of dust or debris collected while sweeping alone with the motor turned OFF. For general use, the simultaneous sweeping and collecting dust and debris while the motor is ON is extremely effective. It will be seen that the collecting compartment 14 is relatively large and is formed with a central suction channel 18 to ensure efficient transfer of negative air pressure or suction to the base of the device between the bristles 15A and 15B.

The housing 11 is, as explained and shown, relatively thin in one direction and yet incorporates vacuum cleaner components. It is necessary, in one sense, that the housing is reasonably wide in another direction, so as to simulate and provide a reasonable brushing width for normal use. The housing can be thin because the battery supply and the operating switch are separated from the housing or, in other words, the housing 11 does not need to incorporate the batteries. The thin shape of the housing 10 enables the bristles to sweep satisfactorily and comfortably even under low overhanging cupboards and also under furniture or under edges of furniture. Normally, the described housing is not much of an obstacle of any sort, and impairs only marginally the view of the user during use.

The compartment is very easily emptied, and at frequent intervals should it be necessary.

Figure 2:
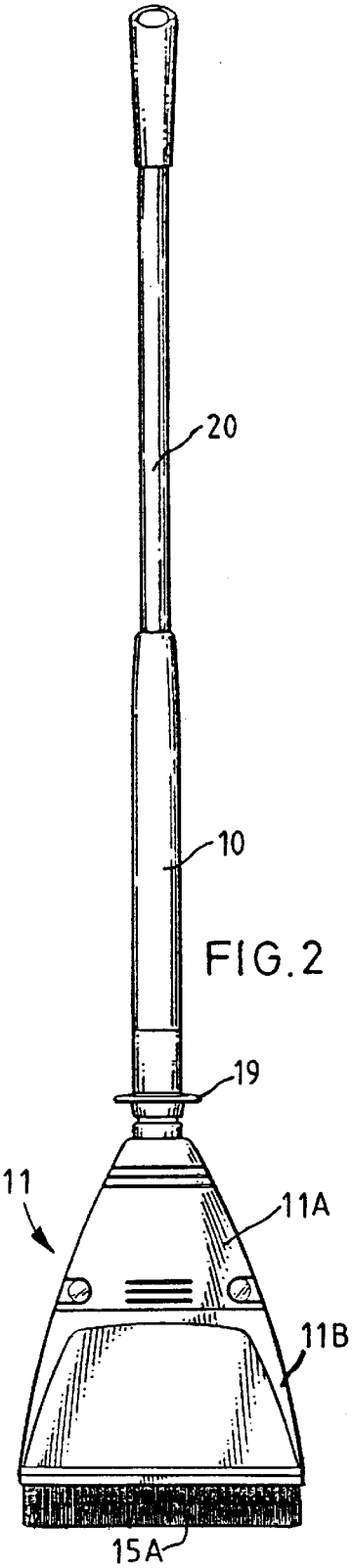
FIG. 2 is a front view of the device.
Figure 3:
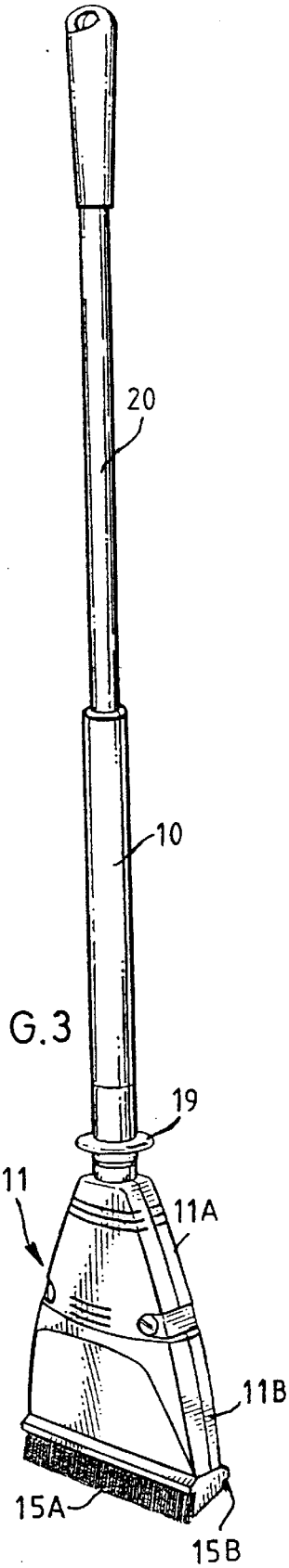
FIG. 3 is an isometric view of the device.

The device shown in FIGS. 5 and 6 is arranged with a screwed connection 21 between the housing 11A and the handle 10. It has already been mentioned that the housings 11A and 11B are somewhat differently releasably joined together. An extendable handle, which replaces the original handle 20, is attached and shown in a fully extendable configuration. In other respects the device shown in FIGS. 5 and 6 is the same as the device in FIGS. 1 to 3, except that a lower housing 22 that supports the bristles is removable. The housing 22 is formed with a curved central mouth that lines up with the suction channel 18.

The housing 11B contains a dust collecting compartment 14 and carries the bristles at its remote end. Embodiments of the invention can include housings 11A of different configurations which carry different bristles and/or different strength brushes or different rubbing elements such as sponges. It is possible to provide a different dust collecting compartment and/or a water barrier so that the device is better able to pick up damp material or water particles without contaminating the motor 12 or the fan 13. In each case, the different housing parts 11B are designed to clip to the housing part 11A so that the vacuum cleaner and in effect different broom attachments can be used and devices of the invention readily adapted as required for different conditions and uses.

The location of the rechargeable batteries 10 in the handle allow greater flexibility in shaping and forming the parts 11A and 11B as has already been mentioned. Further, the in-line batteries are more easily provided in a pack or a support frame. This has special advantage when the batteries are replaced to facilitate containment and proper disposal of the batteries which are normally to be re-cycled and in any event not discarded together with conventional disposables and waste. An added benefit arising from storing the batteries in the handle 10 as described is that the device is much better balanced and more comfortable to use.

It is claimed:

1. A combined vacuum cleaner and broom device comprising a hollow elongate handle having a longitudinal axis extending to a housing at one end, said housing further comprising:

an electric motor, a fan and a dust collecting compartment, two lines of bristles extending across a remote end of said housing, an aperture between said two lines of bristles for passage of dust and debris into said dust collecting compartment, said handle having a battery compartment inside said handle extending along the length of said handle for holding batteries to power said motor; and an electric switch electrically connecting said motor to said batteries, said switch having an operating disc extending externally around said handle and operable by slidable movement parallel said longitudinal axis.

2. A combined vacuum cleaner and broom device according to claim 1 wherein said lines of bristles fit snugly on a floor surface when said broom handle is at a chosen respective angle between 20° and 45° to the vertical.

3. A combined vacuum cleaner and broom device according to claim 1 further comprising a pad of resilient porous material adjacent at least one of said bristle lines, said pad and said at least one bristle line partially closing off said dust passage between said bristles.

* * * * *